US008533984B2

(12) United States Patent
Flynn

(10) Patent No.: US 8,533,984 B2
(45) Date of Patent: Sep. 17, 2013

(54) DISPLAY APPARATUS FOR FILE INDEX

(76) Inventor: Timothy J. Flynn, Key Largo, FL (US)

( * ) Notice: Subject to any disclaimer, the term of this patent is extended or adjusted under 35 U.S.C. 154(b) by 9 days.

(21) Appl. No.: 13/003,524

(22) PCT Filed: Jul. 9, 2009

(86) PCT No.: PCT/US2009/050109
§ 371 (c)(1),
(2), (4) Date: Apr. 18, 2011

(87) PCT Pub. No.: WO2010/006171
PCT Pub. Date: Jan. 14, 2010

(65) Prior Publication Data

US 2011/0192120 A1 Aug. 11, 2011

Related U.S. Application Data

(63) Continuation-in-part of application No. 12/218,075, filed on Jul. 9, 2008, now abandoned, and a continuation-in-part of application No. 12/218,034, filed on Jul. 9, 2008, now Pat. No. 7,854,081, and a continuation of application No. 12/218,075, filed on Jul. 9, 2008, now abandoned.

(51) Int. Cl.
*G09F 23/10* (2006.01)

(52) U.S. Cl.
USPC ..... 40/641; 229/102.5; 229/67.4

(58) Field of Classification Search
USPC ..... 40/359, 641; 229/67.1, 67.3, 67.4, 229/102.5; 206/45.21, 45.29
See application file for complete search history.

(56) References Cited

U.S. PATENT DOCUMENTS

| | | | | |
|---|---|---|---|---|
| 5,966,852 | A | 10/1999 | Drzewiecki | |
| 6,108,953 | A * | 8/2000 | Hall | 40/359 |
| 6,138,900 | A | 10/2000 | Zeller | |
| 7,854,081 | B2 | 12/2010 | Flynn et al. | |
| 2003/0126779 | A1 | 7/2003 | Sato et al. | |
| 2004/0149603 | A1 | 8/2004 | Hodsdon | |
| 2008/0078818 | A1 | 4/2008 | Botkin | |
| 2010/0009110 | A1 | 1/2010 | Flynn et al. | |

FOREIGN PATENT DOCUMENTS

| | | | |
|---|---|---|---|
| EP | 0 876 928 | A1 | 11/1998 |
| KR | 20-0260070 | Y1 | 1/2002 |

OTHER PUBLICATIONS

"Avery+Labels,"http://web.archive.org/web/20051219031220/ http://www.allprosoftware.com/am/screens/Avery+Labels.jpg. Dec. 19, 2005.

* cited by examiner

*Primary Examiner* — Joanne Silbermann
*Assistant Examiner* — Christopher E Veraa
(74) *Attorney, Agent, or Firm* — Pauley Petersen & Erickson

(57) ABSTRACT

A display apparatus that can be positioned within a file cabinet, a file drawer, a hanging file and/or any other suitable file index system. A container is formed by the sheet material. The container has an edge panel forming at least one releasable tab. The at least one releasable tab includes a flap extending from the tab. The flap allows for engaging the corresponding tab, and each tab can be released or positioned away from an outer surface of the edge panel. A label sheet or label assembly has printable labels and at least one identification label. The identification label has or displays an identifier that corresponds to a particular design parameter of the label sheet. The identification label can be attached to the tab. The container can house one or more label sheets.

20 Claims, 6 Drawing Sheets

DISPLAY APPARATUS FOR FILE INDEX

CROSS REFERENCE TO RELATED APPLICATIONS

This application is a national phase entry of PCT International Patent PCT/US2009/050109, which claims priority to U.S. patent application Ser. No. 12/218,034, filed on 9 Jul. 2008, and U.S. patent application Ser. No. 12/218,075, filed on 9 Jul. 2008. This application is also a continuation-in-part of U.S. patent application Ser. No. 12/218,075, filed on 9 Jul. 2008. The co-pending parent applications are hereby incorporated by reference herein in their entirety and are made a part hereof, including but not limited to those portions which specifically appear hereinafter.

BACKGROUND OF THE INVENTION

1. Field of the Invention

This invention relates to a container that can be used to store or house sheet material, such as label sheets, and also to display information for identifying materials housed within the container.

2. Discussion of Related Art

Files, such as hanging files, have index tabs for displaying information to identify contents within the file. For example, hanging files have index tabs that are positioned at an angle, for convenient viewing purposes.

Conventional label sheets contain multiple individual and removable labels. Conventional label sheets have borders surrounding the labels and offer labels in different sizes and shapes.

Many conventional label sheets have a face stock adhered to a base sheet. Conventional adhesives on label sheets adhere more to the face stock than to the base sheet, so that when a face stock label is removed from the base sheet, the layer of adhesive remains with or sticks to the face stock of the label. The face sheet and the adhesive can be used to removably attach or to permanently attach a label with respect to another surface.

SUMMARY OF THE INVENTION

According to the display apparatus and the label assembly of this invention, a container can be formed to house or store label sheets or label assemblies, such as within a compartment formed by the container. For example, label sheets of a particular size, style and/or other design parameter can be stored within the container.

An edge panel formed by the container can have at least one tab that can be released from the edge panel and displayed or positioned away from the edge panel. The tab can be positioned at a particular angle, depending upon a desired viewing arrangement of the tab and the corresponding file. For example, the container can be placed within a file drawer or within a hanging file, so that the tab is visible, such as in a manner similar to conventional index tabs of conventional hanging files. In some embodiments of this invention, the label sheet or label assembly housed within the container can have an identification label that is removable from the label sheet. The identification label can have an adhesive backing for adhering to the releasable tab formed by the edge panel of the container.

In some embodiments of this invention, the releasable tab includes a flap extending from the releasable tab, for engaging the releasable tab during the release of the releasable tab from the edge panel. The flap can be defined along an edge of the edge panel having the releasable tab by a die cut within the sheet material. The flap die cut extends into an adjacent panel such that upon folding the sheet material between the edge panel and an adjacent panel to form the container, the flap simply extends outward from a side of the container.

In some embodiments of this invention, the identification label has an identifier, such as printable text or handwritten text, on the surface of the printable label. In some embodiments of this invention, the identifier can correspond to any design parameter of the label assembly. For example, an alpha character and/or a numeric character can be printed or otherwise placed on the identification label.

With the label sheet and/or the display apparatus according to this invention, it is possible to display ordering information, such as a model number, a stock number, a design style, a label size and/or a label type on the identification label. Thus, when a particular label size or label sheet is required, the user can easily identify which containers house which label sheets or label assemblies. The identifier can also be used to reorder label sheets to replace empty or relatively low stock.

In some embodiments of this invention, the edge panel contains a plurality of tabs. The tabs can be positioned adjacent to each other or spaced apart from each other. Different tabs can be moved or released into different display positions. For example, to achieve a staggered arrangement for better visibility and easier reading, adjacently placed containers can have differently located or sequential tabs each moved into a display position.

In some embodiments of this invention, the tab can be released from the edge portion and then returned back to its normal position and held or locked into its original position by a structural element, such as a folding panel positioned within a slit or other opening. This particular feature can be used to use the releasable tab in one staggered position and then move the container to another area of the file and use a different releasable tab to maintain an overall staggered position or to provide better visibility.

In certain embodiments of this invention, at least a portion of a periphery of the releasable tab has a line of separation, such as a perforation, a microperforation or another suitable tearable line of separation.

The identification label can be positioned in a border area of the label sheet, so that the identification label does not occupy space that is otherwise available for a printable or otherwise usable label. Positioning the identification label within a border area also allows a mechanical printer or other conventional printer to move the label sheet through the printer by applying rollers to the border areas.

The invention further includes a method of packaging a plurality of label sheets. A container is provided that is formed by a sheet material and includes an edge panel with an outer surface and at least one releasable tab that can be positioned away from the outer surface. The method includes engaging a flap of the releasable tab, tearing the releasable tab from the edge panel, lifting the releasable tab to a display position that is at an angle with respect to the edge panel, and attaching an identification label to the releasable tab before or after the tearing and lifting of the releasable tab.

BRIEF DESCRIPTION OF THE DRAWINGS

This invention is explained in view of exemplary embodiments, making reference to the drawings, wherein.

DETAILED DESCRIPTION OF THE INVENTION

Figure 1:
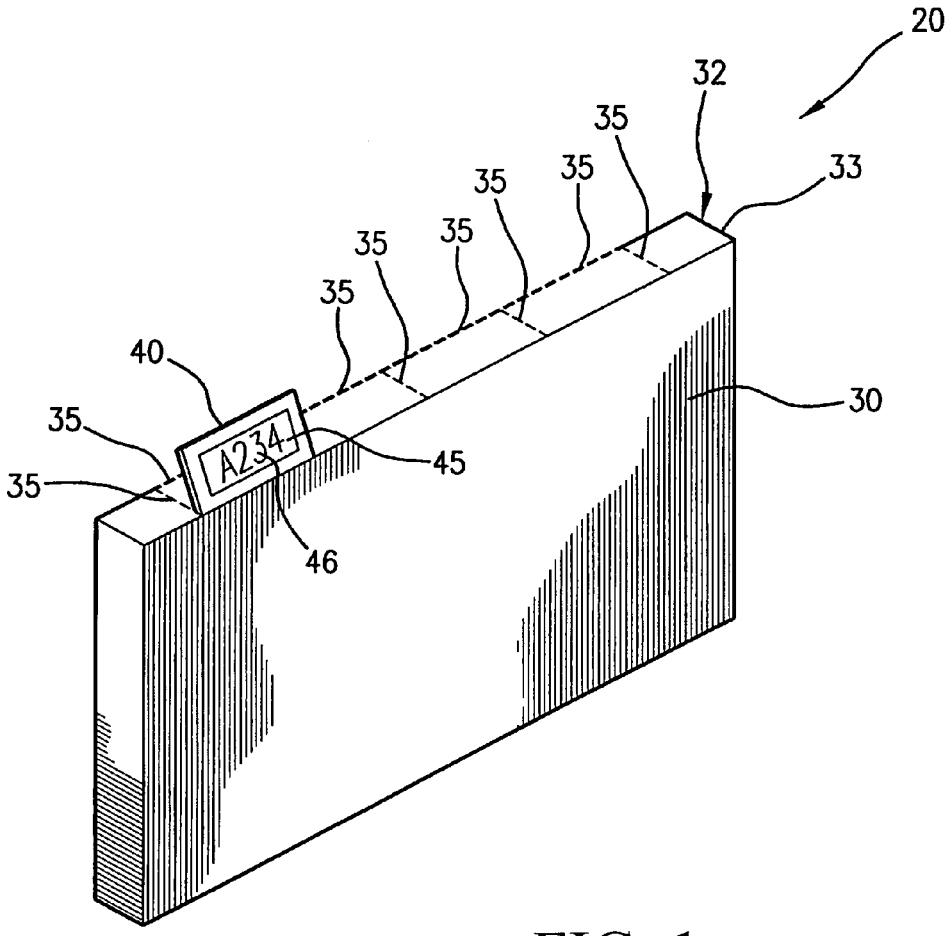
FIG. 1 is a front perspective view of one display apparatus having one tab released or moved into a display position, according to one embodiment of this invention.
Figure 2:
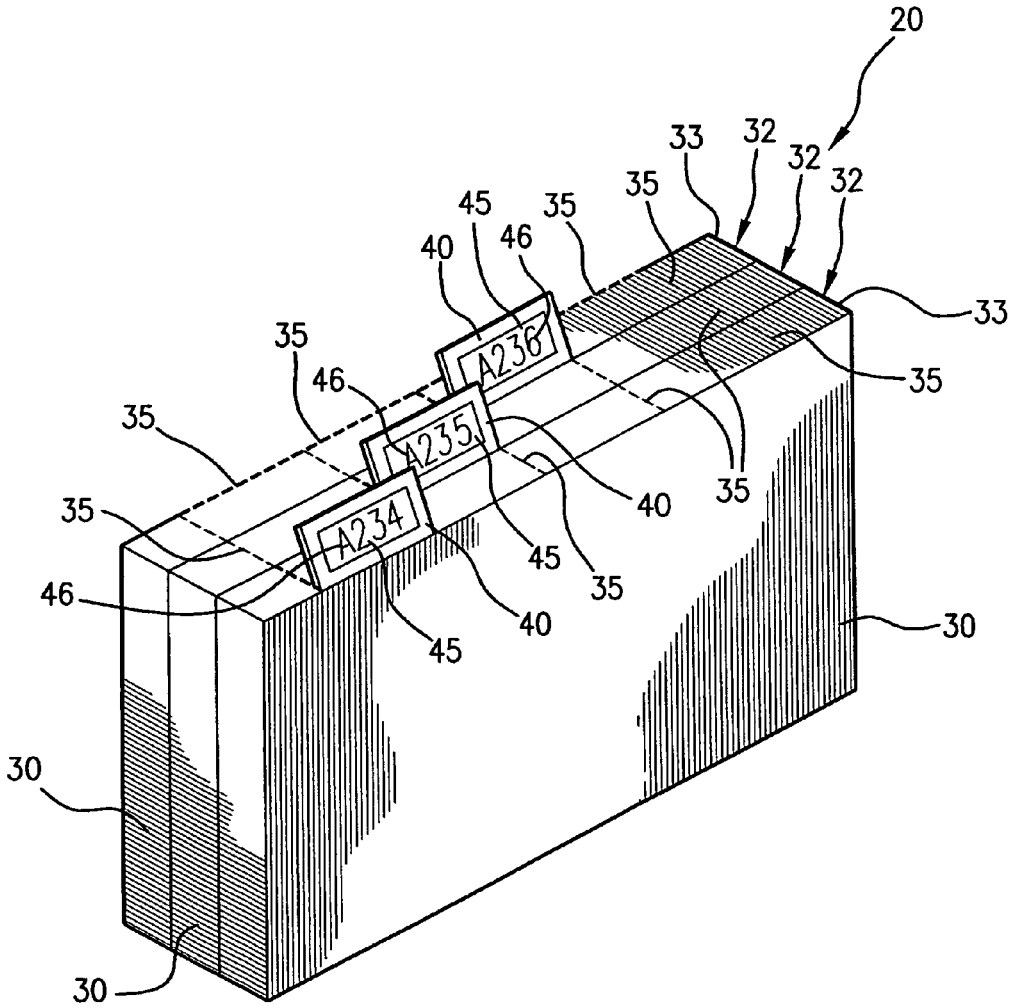
FIG. 2 is a perspective front view of three display apparatuses positioned adjacent to each other, with three tabs, one from each display apparatus, arranged in a staggered configuration, according to another embodiment of this invention.

FIG. 1 shows a perspective view of one display apparatus 20, according to one embodiment of this invention. FIG. 2 is a perspective view that shows the same container 30 of display apparatus 20 as shown in FIG. 1, vertically stacked in front of and grouped together with two other containers 30, according to this invention. As FIG. 2 shows, each container 30 can have a differently positioned tab 40 moved to a display position, so that the overall grouped appearance forms a staggered arrangement. With a staggered arrangement, each tab 40 has better visibility, for example when two or more containers 30 of display apparatuses 20 are positioned in a file drawer, a file cabinet or another similar file index. In other embodiments of this invention, tabs 40 do not form a staggered arrangement.

Figure 3:
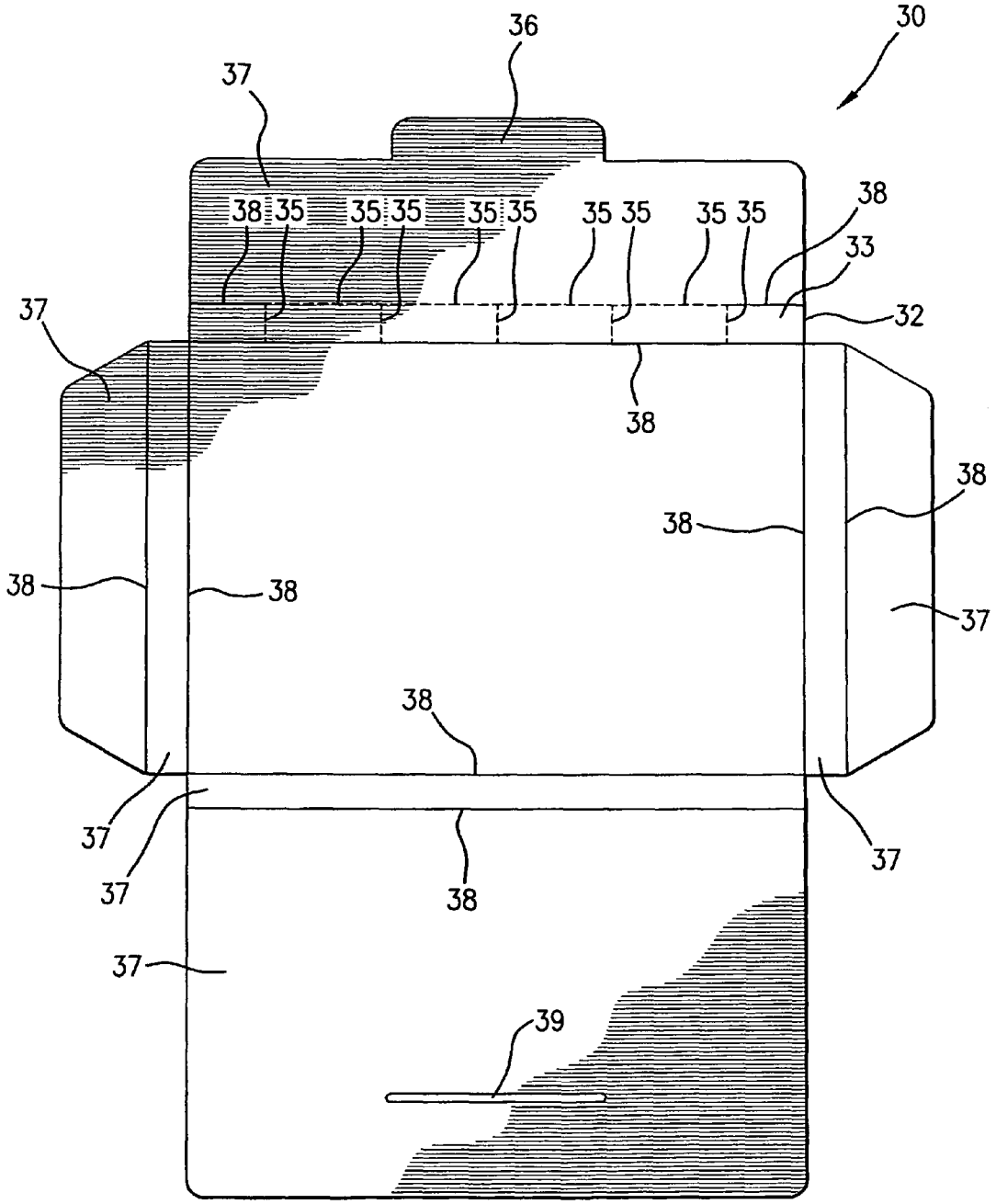
FIG. 3 is a plan view of a container in an unfolded or flat condition, according to one embodiment of this invention.

In certain embodiments of this invention, display apparatus 20 comprises container 30, such as shown in FIG. 1, for example formed by a sheet material such as shown in FIG. 3, having or comprising at least edge panel 32. In some embodiments of this invention, the sheet material comprises a plurality of panels 37, such as shown in FIG. 3. By folding panels 37 about corresponding fold lines 38, such as shown in FIG. 3, a three-dimensional container 30 can be formed or constructed by folding panels 37 as shown in FIG. 3. As shown in FIG. 3, the lowermost panel 37 has opening or slot 39 that accommodates tab 36, when container 30 is constructed.

The sheet material can have the shape shown in FIG. 3 or can have any other suitable shape that results in a desired three-dimensional shape of container 30. As shown in FIG. 1, when container 30 is in a constructed condition or an assembled condition, each side of container 30 has a generally rectangular overall shape. Depending upon the particular use of container 30, panels 37, fold lines 38 and/or the overall configuration of container 30 can have any other suitable shape.

Fold line 38 can be constructed by any suitable line of weakening known to those skilled in the art of container design. For example, fold line 38 can be constructed by bending the sheet material or by forming a perforation line or a die cut within the sheet material.

Once formed into a three-dimensional structure, container 30 can form a storage compartment or a space. In some embodiments of this invention, container 30 holds or houses a plurality of label sheets 50, such as label sheet 50 shown in FIG. 4.

In some embodiments of this invention, label sheet 50 comprises at least one identification label 45. According to certain embodiments of this invention, identifier 46 can be printed on, written on or otherwise applied to a surface of identification label 45. As shown in FIGS. 1 and 2, identification label 45 can be adhered, applied or otherwise made attachable to tab 40.

In some embodiments of this invention, identifier 46 can correspond to a particular model, size, shape and/or other design parameter of label sheet 50 or label assembly 25, such as those stored or housed within a corresponding container 30. Identifier 46 can be used to display or otherwise show, for example, which particular design or style of label sheet 50 is within the corresponding container 30. Identifier 46 can also be used to reorder label sheets 50 when container 30 is empty or nearly empty.

Edge panel 32 forms at least one releasable tab 40 that can be positioned away from outer surface 33 of edge panel 32. As shown in FIG. 3, edge panel 32 has four releasable tabs 40. Container 30 and/or edge panel 32 can have any other suitable number of tabs 40, depending upon the intended use of display apparatus 20. FIG. 3 shows tabs 40 positioned adjacent with respect to each other. In other embodiments of this invention, two or more tabs 40 can be spaced at a distance apart from each other.

FIG. 3 shows the sheet material of container 30 having separation line 35 positioned about at least a portion of a periphery, for example three of four sides, of tab 40. When positioned adjacent to each other, two or more tabs 40 can share a border or a common separation line 35, such as shown in FIG. 3.

As used throughout this specification and in the claims, the phrases separation line, line of separation, tearable line of separation and/or tearable line are intended to be interchangeable with each other and related to a line of weakening within label sheet 50, including but not limited to face sheet 26 and/or back sheet 27. The line of weakening can have a weakened structural area along which label sheet 50, face sheet 26 and/or back sheet 27 can be separated. Each separation line or tearable line of weakening, according to this invention, comprises a perforation line, a microperforation line, a die cut line, a kiss cut line, a score, a score cut line, a laser die cut line, a chemically etched line, a gas etched line and/or any other suitable line that forms a weakened structure. Any separation line according to this invention may comprise any other suitable separation line or line of weakening known to those skilled in the art of label assemblies.

Flynn et al., U.S. Pat. No. 6,837,957, and Flynn et al., U.S. Pat. No. 6,415,976, the entire teachings of both of which are incorporated into this specification by reference, teach different technical features of label sheets, label assemblies and fold lines which can be used as corresponding elements in this invention.

As shown in FIG. 1, releasable tab 40 can be positioned at an angle with respect to outer surface 33 of edge panel 32, or with respect to any other surface of container 30. Tab 40 can form the angle shown in FIGS. 1 and 2 or can form any other suitable angle, depending upon the intended use of display apparatus 20. In certain embodiments of this invention, separation line 35 borders or is routed along only a portion of a periphery of tab 40. With such configuration, tab 40 can be easily retained or attached with respect to the remaining portion of container 30. In other embodiments of this invention, the entire periphery of tab 40 can be bordered by separation line 35. With such arrangement, tab 40 can be pivoted into a display position facing either the front or the back of container 30, which can provide for a more versatile display apparatus 20.

Figure 4:
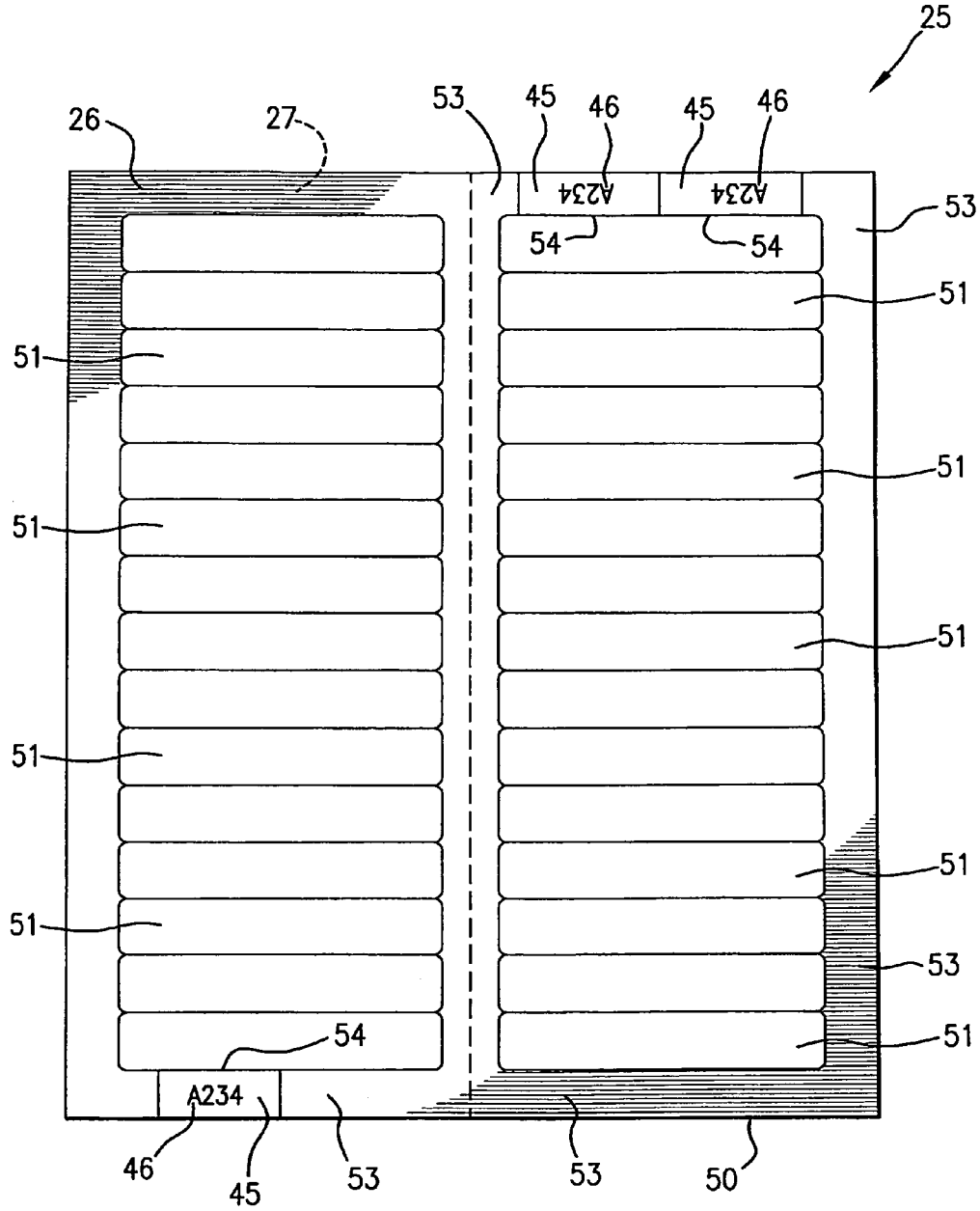
FIG. 4 is a plan view of a label assembly, according to one embodiment of this invention.

As shown in FIG. 4, identification label 45 is positioned in border area or border 53 of label sheet 50. In some embodiments of this invention, particularly where conventional printers require a border for routing label assembly 25 through a printer, border 53 contacts rollers or other mechanical equipment. Border 53 is often a non-usable print area of label sheet 50. In certain embodiments of this invention, identifier 46 can be preprinted on label sheets 50. For example, identifier 46 can be a model number that corresponds to a stock number or order number, such as those that can be used for procuring label sheet 50.

In some embodiments of this invention, a plurality of identification labels 45 are positioned in, within and/or on border 53. As shown in FIG. 4, separation line 54 is common to both printable label 51 and identification label 45. In some embodiments of this invention, for easy use, identification label 45 and printable label 51 can share a common separation line 54. For example, a die cut line can be used to easily start removal of identification label 45 from label assembly 25.

As shown in FIGS. 1-3, each tab 40 forms or has a generally rectangular shape. In other embodiments of this invention, tab 40 can have any other non-rectangular shape or any other suitable shape.

Any separation line 35 of this invention can be structured so that it is relatively easy or relatively difficult to release or fold tab 40 away from edge panel 32. For example, spaces between perforations, depth of die cuts and/or lengths of any separation line 35 can be varied to provide more or less structural support between tab 40 and the remainder of container 30.

The plan view of FIG. 4 shows face sheet 26. As indicated by the dashed element reference line in FIG. 4, back sheet 27 is on the opposite side of face sheet 26. Adhesive can be positioned between face sheet 26 and back sheet 27 so that when identification label 45 and/or printable label 51 each is removed from label assembly 25, adhesive remains on the corresponding portion of face sheet 26 but not on the corresponding portion of back sheet 27.

In some embodiments of this invention, border 53 can completely surround printable labels 51. In other embodiments of this invention, border 53 at least partially surrounds printable labels 51. FIG. 3 shows edge panel 32 positioned so that when in a constructed form, container 30 has only one edge panel 32. In other embodiments of this invention, the sheet material such as shown in FIG. 3 can have two or more edge panels 32 with releasable tabs 40, so that container 30 can be arranged in any other desired direction, orientation or position.

In other embodiments of this invention, identification label 45 can be attached to an order form or a shopping list, to communicate a need to replace or restock label sheets 50 within the corresponding container 30.

As shown in FIG. 4, identification label 45 has non-rounded corners and printable label 51 has rounded corners. In other embodiments of this invention, identification label 45 and/or printable label 51 can have any other suitable shape, size and/or design.

Figure 5:
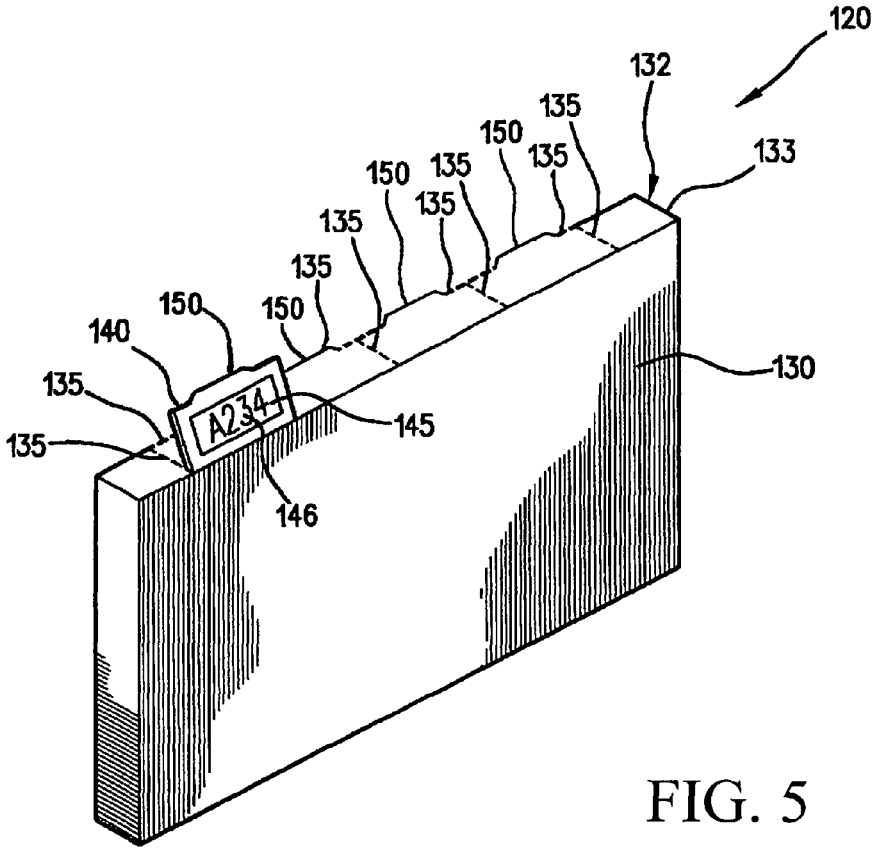
FIG. 5 is a front perspective view of one display apparatus having one tab released or moved into a display position, according to another embodiment of this invention.
Figure 6:
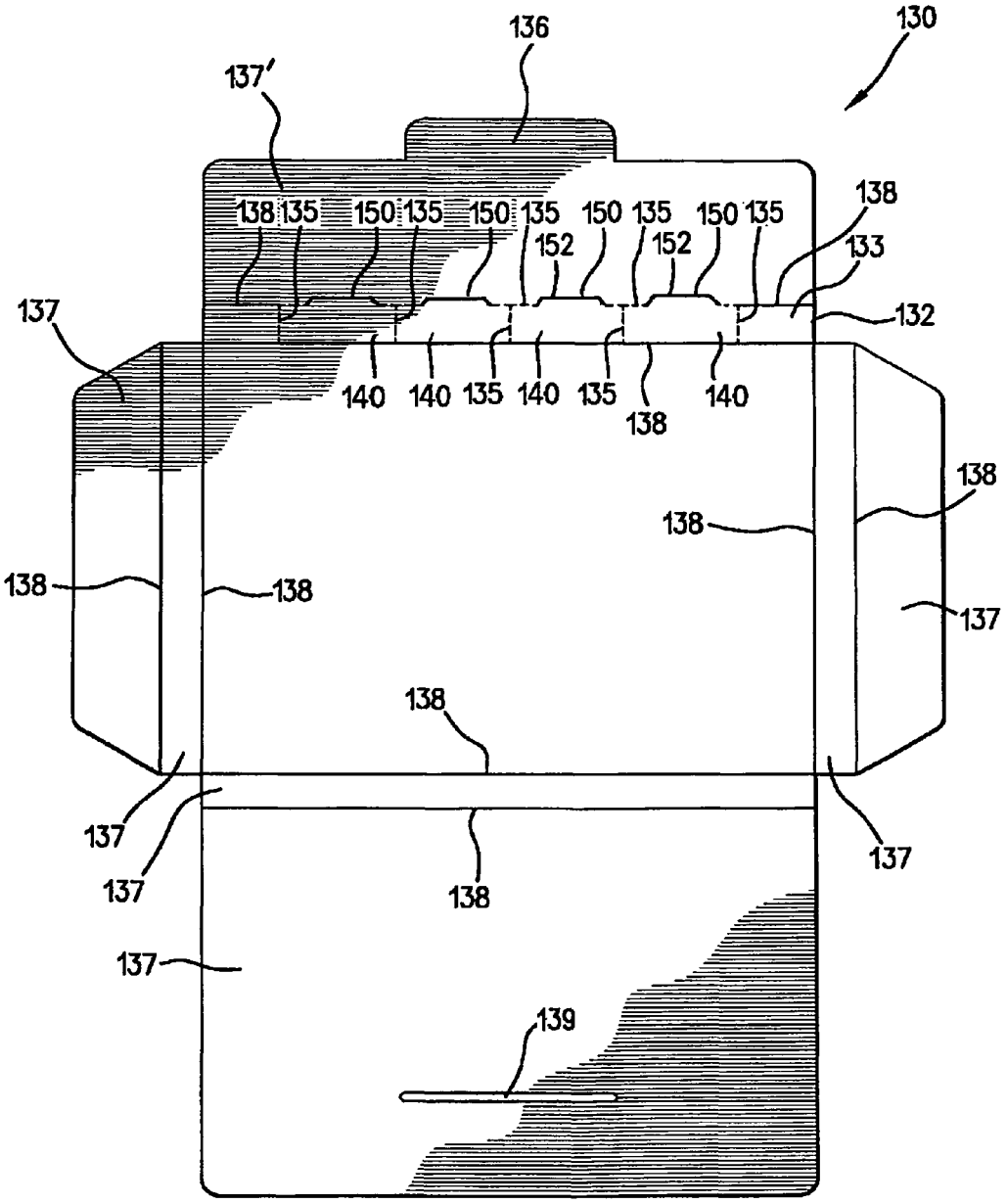
FIG. 6 is a plan view of a container in an unfolded or flat condition, according to one embodiment of this invention.

FIG. 5 shows a perspective view of one display apparatus 120, according to another embodiment of this invention. In certain embodiments of this invention, display apparatus 120 comprises container 130, such as shown in FIG. 5, for example formed by a sheet material such as shown in FIG. 6, having or comprising at least edge panel 132. In some embodiments of this invention, the sheet material comprises a plurality of panels 137, such as shown in FIG. 6. By folding panels 137 about corresponding fold lines 138, such as shown in FIG. 6, a three-dimensional container 130 can be formed or constructed by folding panels 137 as shown in FIG. 6. As shown in FIG. 6, the lowermost panel 137 has opening or slot 139 that accommodates tab 136, when container 130 is constructed.

The sheet material can have the shape shown in FIG. 6 or can have any other suitable shape that results in a desired three-dimensional shape of container 130. Depending upon the particular use of container 130, panels 137, fold lines 138 and/or the overall configuration of container 130 can have any other suitable shape. Fold lines 138 can be constructed by any suitable line of weakening known to those skilled in the art of container design, such as described above. For example, fold line 138 can be constructed by bending the sheet material or by forming a perforation line within the sheet material.

Figure 7:
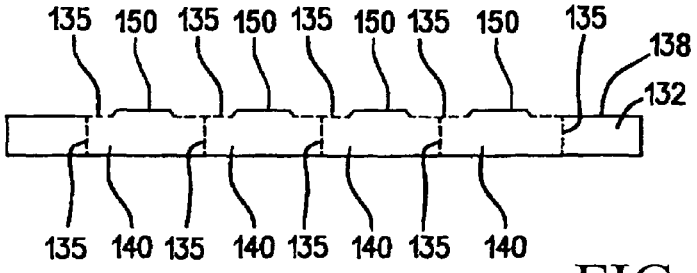
FIG. 7 is a top view of a container according to another embodiment of this invention.

Edge panel 132 forms four releasable tabs 140 that each can be positioned away from outer surface 133 of edge panel 132. As shown in FIGS. 5-7, edge panel 132 has four releasable tabs 140. FIG. 5 shows one of the tabs 140 labeled and positioned at an angle with respect to outer surface 133 of edge panel 132, or with respect to any other surface of container 130.

As shown in FIGS. 5-7, a separation line 135 is positioned about at least a portion of a periphery, for example three of four sides, of tab 140. When positioned adjacent to each other, two or more tabs 140 can share a border or a common separation line 135, such as shown in FIGS. 5-7.

Each releasable tab 140 includes a flap 150 for assisting in releasing the corresponding releasable tab 140 from the surrounding sheet material of the container 130. As shown in FIGS. 5 and 7, the flap 150 is positioned along a fold line of defining a side of the edge panel 132 and, when the container 130 is assembled from the sheet material, extends outward beyond the side of the container 130. Each of the flaps 150 provides a means for engaging the corresponding releasable tab 140 during a release of the releasable tab 140 from the edge panel 132. A consumer can use a finger to break lines 135 and lift, or at least begin lifting, the tab 140 using the flap 150.

As shown in FIGS. 5-7, the edge panel 132 is defined on each of two opposing longitudinal sides by a fold line 138 that connects the edge panel 132 to an adjacent panel 137 of the container 130. The releasable tab 140 extends between the two opposing fold lines 138, and the flap 150 extends beyond one of the two opposing fold lines 138. As shown in FIGS. 5-7, the releasable tab 140 is defined by a tearable line of separation positioned along one of these two opposing fold lines 138, and the flap 150 is defined along a length of one of the fold lines 138 by a die cut 152. The die cut 152 is connected at either end to the tearable line of separation 135 along the one fold line 138.

By using a die cut, or equivalent, to define an edge of the flap 150, the flap 150 is free from attachment to an adjacent panel 137' shown in FIG. 6, and can extend outward without user action upon the folding of the sheet material into the container 130. The remaining tearable line 135 defining the releasable tab 140 can be as described above, and the side of the tab 140 opposite the flap 150 is desirably a non-perforated fold line 138 to allow the tab 140 to be raised above the surface 133 upon breaking the surrounding tearable 135.

The invention thus provides a cut flap integrated with and extending outward from a releasable tab for use by a consumer to release the releasable tab for labeling a container. The consumer user engages the flap of the releasable tab, tears the releasable tab from the surrounding edge panel, and lifts the releasable tab to a display position angled with respect to the edge panel. The releasable tab can be labeled to identify the contents of the container for easy identification within, for example, a drawer for hanging files.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

What is claimed is:

1. A display apparatus for a file index, the display apparatus comprising:

a container formed by a sheet material having an edge panel with an outer surface, the edge panel forming at least one releasable tab that can be positioned away from the outer surface, the sheet material having a tearable line of separation positioned about at least a portion of a periphery of the releasable tab, and a flap extending from the releasable tab for engaging the releasable tab during releasing of the releasable tab from the edge panel, wherein the tearable line of separation comprises a perforation line, a microperforation line, a score cut line, a chemically etched line or a gas etched line, and the flap is defined by a die cut line.

2. A display apparatus according to claim 1, wherein a plurality of releasable tabs are positioned along the edge panel, each including a flap extending therefrom.

3. A display apparatus according to claim 2, wherein the releasable tabs are positioned adjacent to each other and each of the flaps are positioned along a fold line of defining a side of the edge panel.

4. A display apparatus according to claim 1, wherein the flap extends outward from a side of the container.

5. A display apparatus for a file index, the display apparatus comprising:

a container formed by a sheet material having an edge panel with an outer surface, the edge panel forming at least one releasable tab that can be positioned away from the outer surface, the sheet material having a tearable line of separation positioned about at least a portion of a periphery of the releasable tab, and a flap extending from the releasable tab for engaging the releasable tab during releasing of the releasable tab from the edge panel;

wherein the edge panel is defined on each of two opposing sides by a fold line connecting the edge panel to an adjacent panel of the container, the releasable tab extends between the two opposing fold lines, and the flap extends beyond one of the two opposing fold lines.

6. A display apparatus according to claim 5, wherein the releasable tab is defined by a tearable line of separation positioned along one of the two opposing fold lines, and the flap is defined along a length by a die cut.

7. A display apparatus according to claim 5, wherein the tearable line of separation comprises the sheet material having a perforation line, a microperforation line, a score cut line, a chemically etched line or a gas etched line, and the flap is defined by a die cut line.

8. A display apparatus according to claim 1, wherein in a display position the releasable tab is positioned at an angle with respect to the outer surface of the edge panel.

9. A display apparatus according to claim 1, wherein the sheet material comprises a plurality of panels and a fold line separating each of the panels from an adjacent panel, and the container includes the sheet material folded about the fold lines.

10. A display apparatus according to claim 1, wherein the at least one releasable tab has a rectangular shape and the sheet material includes the tearable line of separation along three edges of the at least one releasable tab.

11. A display apparatus according to claim 1, wherein the container forms a storage compartment containing a plurality of label sheets.

12. A display apparatus according to claim 1, wherein at least one of the plurality of label sheets includes an identification label that is attachable to the at least one releasable tab, wherein the identification label comprises an identifier that corresponds to a size of the label sheets housed within the container.

13. A display apparatus for packaging a plurality of label sheets, the display apparatus comprising:

a sheet material including a plurality of panels each separated from an adjacent panel by a fold line;

one of the plurality of panels being an edge panel including an outer surface;

a releasable tab defined within the edge panel by at least one tearable line of separation and foldable away from the edge panel;

a flap extending from the releasable tab and defined along an edge by a die cut within the sheet material.

14. A display apparatus according to claim 13, wherein along one side the releasable tab shares a fold line with the edge panel, and the flap is disposed on an opposite side of the releasable tab from the shared fold line.

15. A display apparatus according to claim 13, further comprising a plurality of releasable tabs positioned along the edge panel, each including a flap extending therefrom, wherein the releasable tabs are positioned adjacent to each other and each of the flaps are positioned along a fold line of defining a side of the edge.

16. A display apparatus according to claim 13, wherein the flap extends outward from a side of a container formed from the sheet material.

17. A display apparatus according to claim 13, wherein the edge panel is defined on each of two opposing sides by a fold line, the releasable tab extends between the two opposing fold lines, and the flap extends beyond one of the two opposing fold lines.

18. A method of packaging a plurality of label sheets, the method comprising:

providing a container formed by a sheet material and including an edge panel with an outer surface and at least one releasable tab that can be positioned away from the outer surface;

engaging a flap of the releasable tab, wherein the flap is defined by a die cut extending along a portion of the releasable tab;

tearing the releasable tab from the edge panel;

lifting the releasable tab to a display position that is at an angle with respect to the edge panel;

attaching an identification label to the releasable tab before or after the tearing and lifting of the releasable tab.

19. The method according to claim 18, further comprising providing the container by folding the sheet material along each of a plurality of fold lines defined in the sheet material, and folding the sheet material along a fold line adjacent to the edge panel to extend the flap outward from a side of the container.

20. The method according to claim 18, further comprising:

providing a second container formed by a sheet material and including an edge panel with an outer surface and at least one releasable tab that can be positioned away from the outer surface;

engaging a flap of the releasable tab of the second container;

tearing the releasable tab of the second container from the edge panel;

lifting the releasable tab of the second container to a display position that is at an angle with respect to the edge panel;

attaching an identification label to the releasable tab of the second container before or after the tearing and lifting of the releasable tab;

placing the container adjacent the second container, wherein the lifted release tab of the second container is offset from the lifted release tab of the container to form a staggered arrangement.

* * * * *